US009871322B2

(12) United States Patent
Kanda et al.

(10) Patent No.: US 9,871,322 B2
(45) Date of Patent: Jan. 16, 2018

(54) CONNECTOR

(71) Applicant: Yazaki Corporation, Minato-ku, Tokyo (JP)

(72) Inventors: Hidenori Kanda, Makinohara (JP); Hiromasa Kubota, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/596,082

(22) Filed: May 16, 2017

(65) Prior Publication Data

US 2017/0346225 A1 Nov. 30, 2017

(30) Foreign Application Priority Data

May 30, 2016 (JP) ..... 2016-107423

(51) Int. Cl.
*H01R 13/62* (2006.01)
*H01R 13/629* (2006.01)

(52) U.S. Cl.
CPC ..... *H01R 13/62977* (2013.01)

(58) Field of Classification Search
CPC ..... H01R 13/62977
USPC ..... 439/157, 372, 752
See application file for complete search history.

(56) References Cited

U.S. PATENT DOCUMENTS 8,197,271 B2 * 6/2012 Kobayashi ..... H01R 13/62955 439/157
9,774,127 B2 * 9/2017 Yamaki ..... H01R 13/506
2002/0177338 A1 * 11/2002 Nishide ..... H01R 13/62938 439/157
2003/0017733 A1 * 1/2003 Fujii ..... H01R 13/62938 439/157
2006/0089030 A1 * 4/2006 Fukatsu ..... H01R 13/62938 439/157
2006/0154511 A1 * 7/2006 Okura ..... H01R 13/4538 439/372
2006/0286834 A1 * 12/2006 Fukatsu ..... H01R 13/62938 439/157
2007/0010113 A1 * 1/2007 Fukatsu ..... H01R 13/62938 439/157
2007/0026706 A1 * 2/2007 Matsubara ..... H01R 13/62955 439/157

(Continued)

FOREIGN PATENT DOCUMENTS

JP 201238498 A 2/2012

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

A connector includes a lever drawing and fitting a first housing and a second housing by moving from a temporary lock position to a final lock position. The lever includes a lever-side lock portion elastically deformable in a first direction away from a surface of the first housing, and including a reinforcing rib that enhances rigidity against a deformation of the lever-side lock protrusion. The first housing includes a housing-side lock portion which locks the lever-side lock portion when the lever is in the temporary lock position, which inhibits movement of the lever to the final lock position during locking, and which permits the lever to move to the final lock position when the locking is released. The second housing includes a lock releasing portion which pushes the lever-side lock portion in the first direction so as to release the locking.

3 Claims, 7 Drawing Sheets

(56) References Cited

U.S. PATENT DOCUMENTS

| | | | | |
|---|---|---|---|---|
| 2007/0207647 | A1* | 9/2007 | Imai | H01R 13/62938 439/157 |
| 2007/0207648 | A1* | 9/2007 | Fukatsu | H01R 13/62938 439/157 |
| 2009/0023317 | A1* | 1/2009 | Mizoguchi | H01R 13/62938 439/157 |
| 2011/0217865 | A1* | 9/2011 | Mito | H01R 13/514 439/345 |
| 2011/0230071 | A1* | 9/2011 | Shamoto | H01R 13/5213 439/157 |
| 2012/0034812 | A1* | 2/2012 | Tanaka | H01R 13/62938 439/372 |
| 2013/0065412 | A1* | 3/2013 | Ikeda | H01R 13/62938 439/157 |
| 2013/0228429 | A1* | 9/2013 | Henmi | H01R 13/62933 200/335 |
| 2013/0237078 | A1* | 9/2013 | Ikeda | H01H 9/102 439/157 |
| 2014/0134862 | A1* | 5/2014 | Itou | H01R 13/62944 439/157 |
| 2014/0235081 | A1* | 8/2014 | Shimizu | H01R 13/62933 439/157 |
| 2015/0004812 | A1* | 1/2015 | Hara | H01R 12/714 439/76.1 |
| 2015/0325950 | A1* | 11/2015 | Kamiya | H01R 13/62938 439/157 |
| 2016/0190738 | A9* | 6/2016 | Henmi | H01R 13/62933 439/157 |
| 2016/0226187 | A1* | 8/2016 | Sakamoto | H01R 13/62955 |
| 2017/0110830 | A1* | 4/2017 | Yamada | H01R 13/62927 |

* cited by examiner

CONNECTOR

CROSS-REFERENCE TO RELATED APPLICATION(S)

This application is based on and claims priority from Japanese Patent Application (Application No. 2016-107423) filed on May 30, 2016, the entire contents of which are incorporated herein by reference.

BACKGROUND

Field of the Invention

One or more embodiments of the present invention relate to a connector including a first housing, a second housing fittable to the first housing, and a lever attachable to the first housing to draw and fit the first housing and the second housing to each other by moving from a temporary lock position to a final lock position.

Description of Related Art

A lever type connector having a lever for assisting housings of the connector to be fitted to each other has been proposed in the background art.

For example, in one of such background-art lever type connectors (hereinafter referred to as "background-art connector"), a lever is rotatably attached to one of housings, and a temporary lock protrusion is provided in the housing so that a temporary lock arm provided in the lever can be locked to the temporary lock protrusion. The temporary lock protrusion locks the temporary lock arm as soon as the lever is rotated to a predetermined position (temporary lock position). Thus, the temporary lock protrusion can inhibit the lever from further rotating (rotating toward a final lock position). However, when the temporary lock arm is bent by a temporary lock releasing portion provided in the other housing to thereby release the locking between the temporary lock arm and the temporary lock protrusion, the lever can rotate further. In this manner, according to the background-art connector, when proper fitting is not established between the two housings (for example, when there is a distance between the housings), the lever is retained in the temporary lock position so that the lever can be prevented from rotating unintentionally (for example, see JP-A-2012-38498).

SUMMARY

The temporary lock arm of the background-art connector has a cantilever-like shape formed out of a thin plate. The magnitude of a force (locking force) with which the temporary lock arm can retain the lever in the temporary lock position against an external force depends on thickness, width, length, etc. of the temporary lock arm. Therefore, for example, when an excessive external force acts on the lever, the temporary lock arm may be bent to release the locking between the temporary lock arm and the temporary lock protrusion in spite of an improper fitting time. To say other words, the lever may be rotated unintentionally in spite of the improper fitting time.

When the lever is rotated unintentionally as described above, some measures are required before starting a proper fitting step (by rotation of the lever, or the like) in order to perform fitting. For example, the lever has to be returned to the temporary lock position by manual operation of a worker. Therefore, such rotation does not have any influence on the essential function (assisting fitting by the lever) of the background-art connector, but can cause deterioration in workability in the fitting step.

One or more embodiments of the present invention have been developed in consideration of the above-described situation, and an object thereof is to provide a connector capable of preventing unintentional movement of a lever as much as possible when fitting between housings is not established.

One or more embodiments of the present invention provides a connector as described in the following aspects <1> to <3>.

<1> A connector including: a first housing; a second housing fittable to the first housing; and a lever attachable to the first housing to draw and fit the first housing and the second housing to each other by moving from a temporary lock position to a final lock position, wherein the lever includes a lever-side lock portion which is elastically deformable in a first direction away from a surface of the first housing, and which includes a reinforcing rib that enhances rigidity against a deformation of the lever-side lock protrusion, wherein the first housing includes a housing-side lock portion which locks the lever-side lock portion when the lever is in the temporary lock position, which inhibits movement of the lever to the final lock position when the housing-side lock portion locks the lever-side lock portion, and which permits the lever to move to the final lock position when the housing-side lock portion is released from locking of the lever-side lock portion, and wherein the second housing includes a lock releasing portion which pushes the lever-side lock portion in the first direction so as to release locking between the lever-side lock portion and the housing-side lock portion.

<2> The connector according to the aspect <1>, wherein the lever further includes a connection portion that is connected to the first housing so that the lever can perform the movement, and a cut that is provided between the connection portion and the lever-side lock portion, and wherein the lever-side lock portion has a cantilever-like shape having a fixed end near a deepest portion of the cut.

<3> The connector according to the aspect <1> or <2>, wherein the first housing and the second housing are fitted to each other such that a peripheral wall of the first housing and a peripheral wall of the second housing overlap each other, and wherein the first housing includes a guide slit which penetrates the peripheral wall of the first housing and which extends in a fitting direction so as to guide the lock releasing portion toward the lever-side lock portion in a state in which the lock releasing portion has penetrated the peripheral wall of the first housing.

According to the connector having the aspect <1>, the lever-side lock portion is locked to the housing-side lock portion when fitting between the housings is not established, while the locking to the housing-side lock portion is released by the temporary lock releasing portion provided in the second housing when fitting is established. Further, the lever-side lock portion includes the reinforcing rib for enhancing rigidity against deformation (elastic deformation for releasing the locking). Thus, it is possible to more surely prevent the lever-side lock portion from being unintentionally separated from the housing-side lock portion (that is, from being unintentionally released from the locking), than in a case where the reinforcing rib is absent as in the background-art connector.

According to the connector having the configuration, it is therefore possible to prevent unintentional movement of the lever as much as possible when fitting between the housings is not established.

Incidentally, the term "rigidity" means a force (load/deformation amount) required for generating a unit quantity of deformation in an object (the lever-side lock portion), and expresses a degree of difficulty in deforming the object. The rigidity includes bending rigidity, shearing rigidity, torsional rigidity, etc.

According to the connector having the aspect <2>, it is possible to prevent the locking between the lever-side lock portion and the housing-side lock portion from being unintentionally released, and further to prevent the lever from being separated from the first housing (that is, to prevent the lever from coming off). Specifically, if the reinforcing rib is provided in the lever-side lock portion as in the aspect <1>, the rigidity of the lever-side lock portion may become so high in some cases that a connection portion between the lever and the first housing can be deformed largely in place of deformation in the lever-side lock portion when the locking between the lever-side lock portion and the housing-side lock portion is released (that is, when the locking is intentionally released). Thus, the lever may be separated from the first housing (that is, the lever may come off). On the other hand, according to the connector having the aspect <2>, a cut is provided between the connection portion between the lever and the first housing, and the lever-side lock portion (as a result, the lever-side lock portion has a cantilever-like shape). Due to the cut, the connection portion is hardly deformed even when the lever-side lock portion is pushed by the temporary lock releasing portion, as compared with a case where the cut is absent. As a result, the lever and the first housing are hardly separated from each other (that is, the lever hardly comes off). Thus, the connector having the aspect <2> can make it compatible to attain both the prevention of the locking between the lever-side lock portion and the housing-side lock portion from being unintentionally released and the prevention of the lever from being separated from the first housing (that is, the prevention of the lever from coming off).

According to the connector having the aspect <3>, the temporary lock releasing portion of the second housing can be easily directed toward the lever-side lock portion through the guide slit at the fitting time. To say other words, the temporary lock releasing portion and the lever-side lock portion can be easily aligned with each other. Thus, according to the connector having the configuration, it is possible to further improve workability in the fitting step.

According to one or more embodiments of the invention, it is possible to provide a connector capable of preventing unintentional movement of a lever as much as possible when fitting between housings is not established.

One or more embodiments of invention have been described briefly above. The further details of the invention will be made clearer if the following embodiments described in the detailed description are read through with reference to the accompanying drawings.

DETAILED DESCRIPTION

Embodiment

A connector according to an embodiment of the invention will be described below with reference to the drawings.

Figure 1:
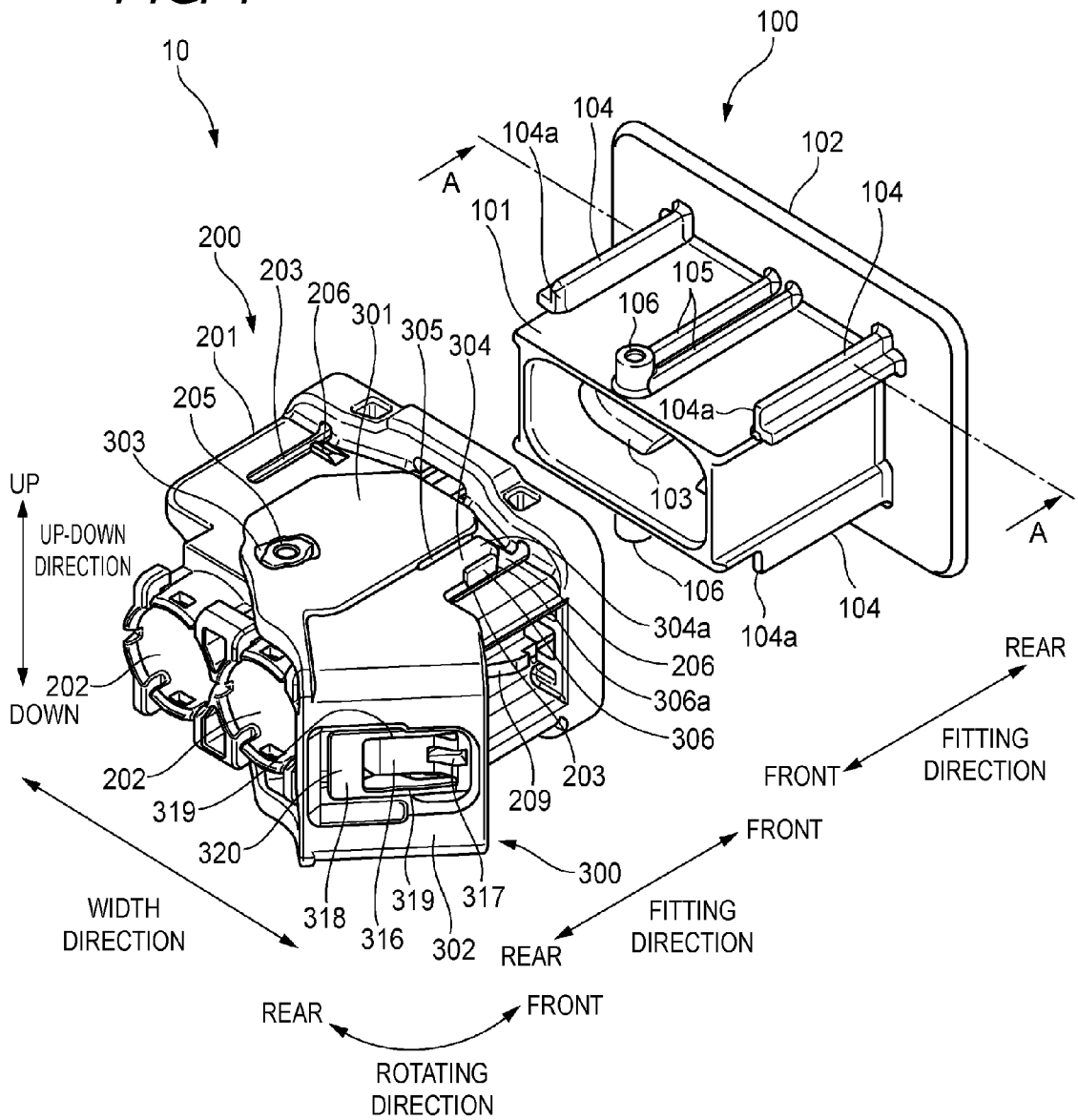
FIG. 1 is a perspective view of a connector according to an embodiment of the invention.

As shown in FIG. 1, a connector 10 according to the embodiment of the invention includes a male housing 100, a female housing 200, and a lever 300. The female housing 200 is fitted to the male housing 100 so that the female housing 200 can receive the male housing 100 (that is, the male housing 100 can be internally inserted into the female housing 200). The lever 300 is rotatably attached to the female housing 200. Incidentally, the connector 10 according to the embodiment is a connector for a board, in which the male housing 100 can be attached to an electronic circuit board or the like (not shown).

A "fitting direction", a "width direction", an "up/down direction", a "front side", a "rear side", an "upper side", a "lower side", and a "rotating direction" of the lever 300 will be defined below as shown in FIG. 1. The "fitting direction", the "width direction" and the "up/down direction" are perpendicular to one another. Further, a "time when the male housing 100 and the female housing 200 are fitted to each other" will be also referred to as "fitting time". FIG. 1 shows a state in which the lever 300 is in a temporary lock position. When the lever 300 is rotated forward in the rotating direction from the temporary lock position, the lever 300 moves toward a final lock position.

As shown in FIG. 1, the male housing 100 is made of resin and provided with a body peripheral wall portion 101 and a flange portion 102. The body peripheral wall portion 101 is formed into an angular cylindrical shape long in the width direction. The flange portion 102 has a rectangular shape extending in the up/down direction and the width direction integrally from a rear end portion of the body peripheral wall portion 101. Inside the body peripheral wall portion 101, a plurality of terminal reception chambers 103 are formed in the fitting direction. A plurality of male terminals (not shown) formed in the male housing 100 by insert molding are received in the terminal reception chambers 103 respectively (also see FIG. 12).

Temporary lock releasing ribs 104 are formed in the four corners of the body peripheral wall portion 101 respectively. The temporary lock releasing ribs 104 protrude outward in the up/down direction and extend forward in the fitting direction from the flange portion 102. Central ribs 105 and bosses 106 are formed in central portions of upper and lower surfaces of the body peripheral wall portion 101 respectively. The central ribs 105 protrude outward in the up/down direction and extend forward in the fitting direction from the flange portion 102. The bosses 106 are located in front end portions of the central ribs 105 and protrude outward in the up/down direction to be higher than the central ribs 105, respectively. The temporary lock releasing ribs 104 and the bosses 106 will be described in detail later.

Figure 2:
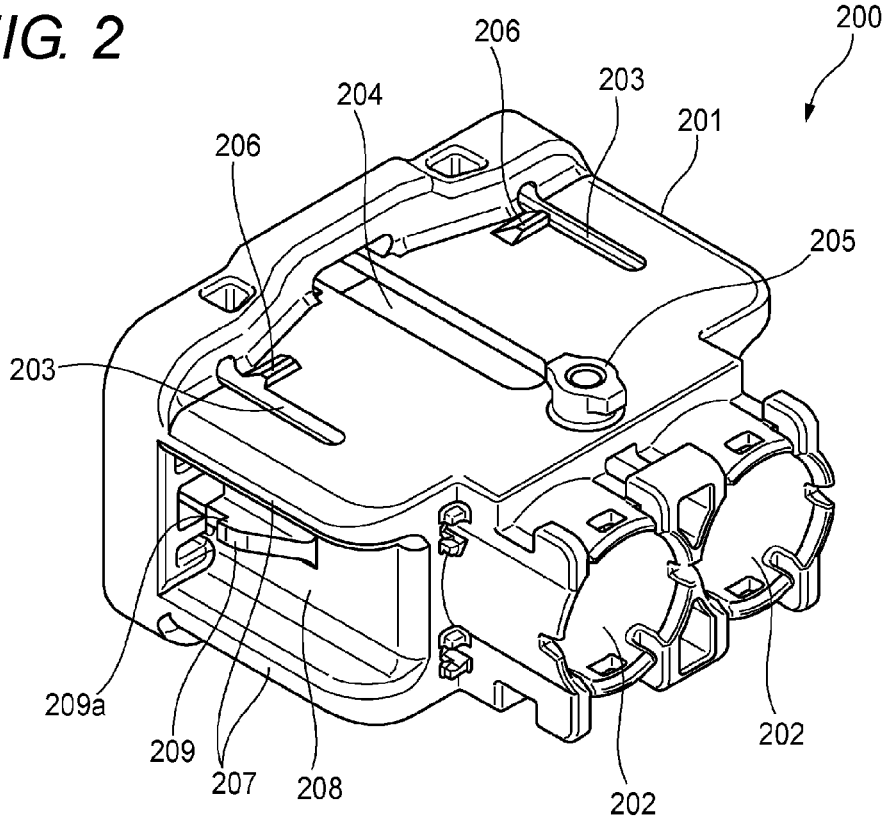
FIG. 2 is a perspective view in which a female housing is observed from its back side.

As shown in FIG. 1 and FIG. 2, the female housing 200 is made of resin, and provided with a body peripheral wall portion 201 having an angular cylindrical shape long in the width direction. The male housing 100 and the female housing 200 are fitted so that an inner circumferential surface of the body peripheral wall portion 201 and an outer circumferential surface of the body peripheral wall portion 101 of the male housing 100 can overlap each other at the fitting time. Inside the body peripheral wall portion 201, a plurality of terminal reception chambers 202 are formed in the fitting direction so that a plurality of female terminals (not shown) connected to end portions of electric wires (not shown) can be received in the terminal reception chambers 202 respectively.

Slits 203 are formed near opposite end portions of upper and lower surfaces of the body peripheral wall portions 201 in the up/down direction. The slits 203 penetrate the peripheral wall and extend rearward in the fitting direction from a front end portion of the body peripheral wall portion 201. A front end of each slit 203 is open forward in the fitting direction. Each slit 203 extends rearward up to the vicinity of a central portion of the body peripheral wall portion 201 in the fitting direction. Central slits 204 are formed in central portions of the upper and lower surfaces of the body peripheral wall portion 201 respectively. The central slits 204 penetrate the peripheral wall and extend rearward in the fitting direction from the front end portion of the body peripheral wall portion 201. A front end of each slit 204 is open forward in the fitting direction. Each slit 204 extends rearward up to the vicinity of the central portion of the body peripheral wall portion 201 in the fitting direction.

At the fitting time, the temporary lock releasing ribs 104 of the male housing 100 are inserted and guided into corresponding ones of the slits 203 respectively so that outside end portions of the temporary lock releasing ribs 104 in the up/down direction can protrude from the peripheral wall (that is, the temporary lock releasing ribs 104 can penetrate the peripheral wall), and the bosses 106 of the male housing 100 are inserted and guided into corresponding ones of the central slits 204 respectively so that outside end portions of the bosses 106 in the up/down direction can protrude from the peripheral wall (that is, the bosses 106 can penetrate the peripheral wall).

In the upper and lower surfaces of the body peripheral wall portion 201, rotating shafts 205 are formed in rear positions of the rear end portions of the central slits 204 respectively so as to protrude outward in the up/down direction. A pair of holes 303 of the lever 300 (connection portions between the lever 300 and the female housing 200) are fitted to the pair of rotating shafts 205. Thus, the lever 300 can be attached to the female housing 200 rotatably around the pair of rotating shafts 205.

In the upper and lower surfaces of the body peripheral wall portion 201, temporary lock protrusions 206 are formed adjacently to the inner sides of the slits 203 in the width direction respectively so as to protrude outward in the up/down direction. The temporary lock protrusions 206 are provided to lock the lever 300 in a temporary lock position (as will be described in detail later).

A pair of ribs 207 are formed in each of opposite side surfaces of the body peripheral wall portion 201 in the width direction. The ribs 207 protrude outward in the width direction from the upper and lower walls, and extend in the fitting direction and in parallel to each other. As a result, a recess portion 208 sinking inward in the width direction is formed between each pair of ribs 207. In a bottom surface of each recess portion 208, a lock beak 209 is formed to protrude outward in the width direction. A step portion 209*a* is formed in an outer end portion of each lock beak 209 in the width direction. The pairs of ribs 207 (the recess portions 208) and the lock beaks 209 are provided so that the lever 300 located in a final lock position can be retained in the final lock position (as will be described in detail later).

As shown in FIG. 1 and FIGS. 3 to 5, the lever 300 is made of resin and formed into an approximately U-shape, including a pair of side plate portions 301 and a connection portion 302 connecting one ends of the pair of side plate portions 301 with each other. A pair of holes 303 which are through holes are formed in the pair of side plate portions 301. The pair of rotating shafts 205 of the female housing 200 are inserted into the pair of holes 303 so that the lever 300 can be rotated relatively to the female housing 200 (around the pair of rotating shafts 205) in a state where the pair of side plate portions 301 have held the upper and lower surfaces of the female housing 200.

Cuts 305 (for example, see FIG. 5) such as slits are formed in front end portions of the pair of side plate portions 301 in the rotating direction respectively. As a result, in the front end portions of the pair of side plate portions 301 in the rotating direction, a pair of temporary lock arms 304 are formed adjacently to the pair of cuts 305. Each temporary lock arm 304 has a long and narrow cantilever-like shape having a fixed end in the vicinity of a deepest portion of a corresponding one of the cuts 305.

As shown in FIG. 1, in the state where the lever 300 is in the temporary lock position, front end portions 304*a* of the pair of temporary lock arms 304 are located in rotating positions to the front of female housing 200, and locked to the temporary lock protrusions 206 of the male housing 200. Since the temporary lock arms 304 are locked to the temporary lock protrusions 206, the lever 300 is locked in the temporary lock position while the lever 300 is inhibited from moving to the final lock position.

Figure 3:
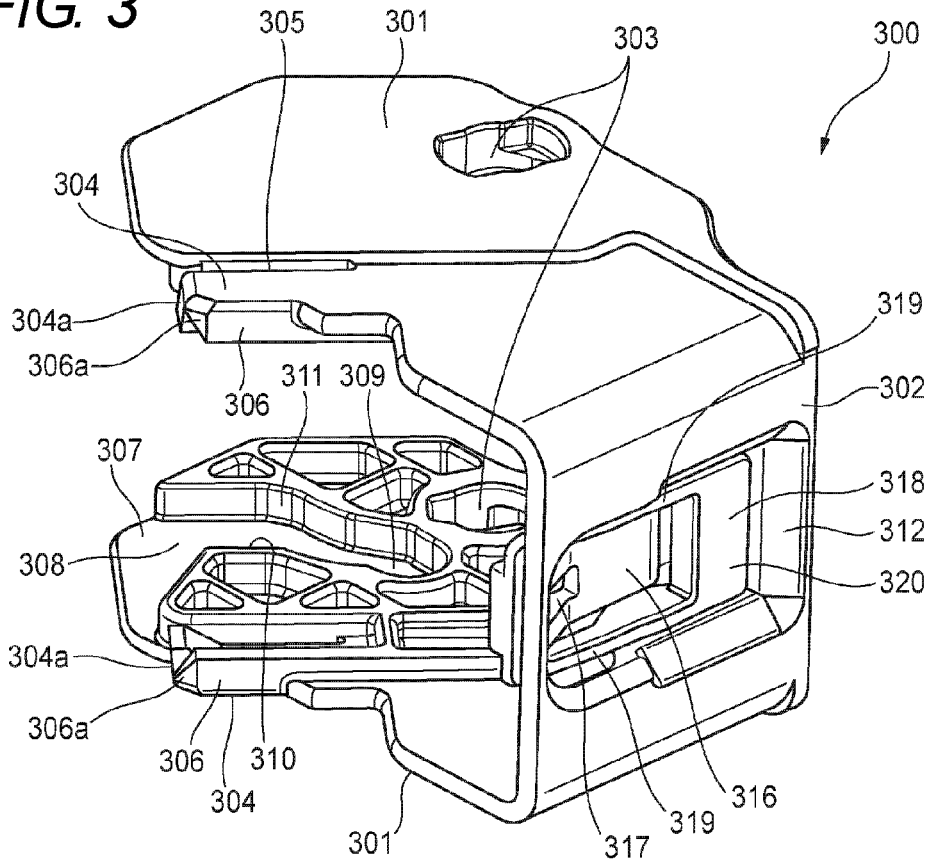
FIG. 3 is a perspective view in which a lever is observed from the outside (the outside of the lever if the lever is attached to the female housing).
Figure 4:
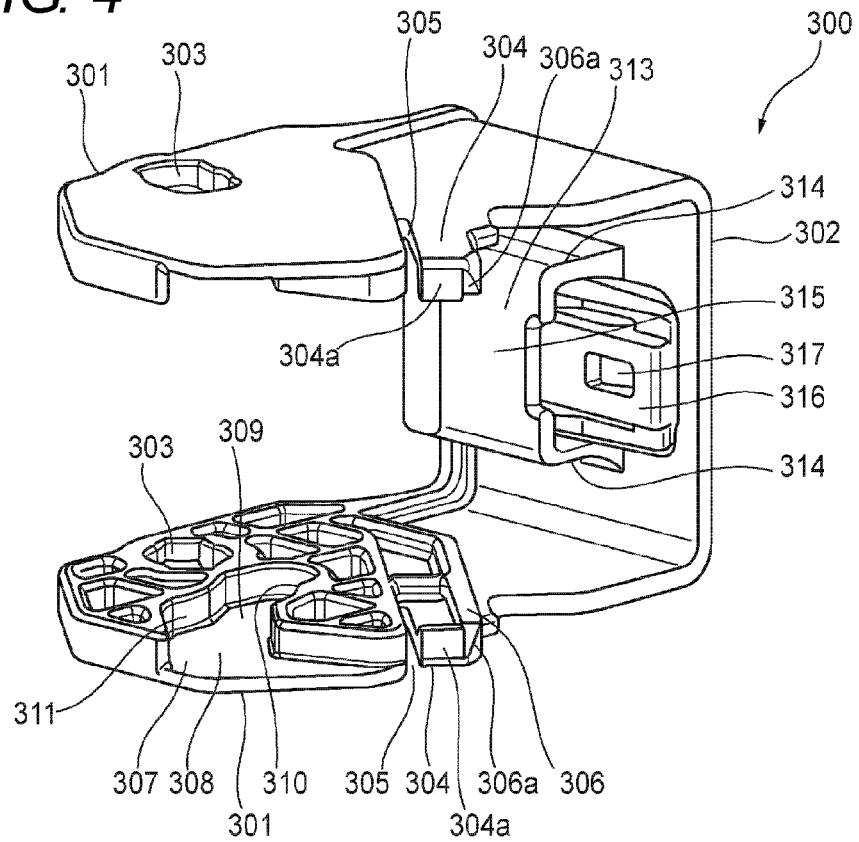
FIG. 4 is a perspective view in which the lever is observed from the inside (the inside of the lever if the lever is attached to the female housing).
Figure 5:
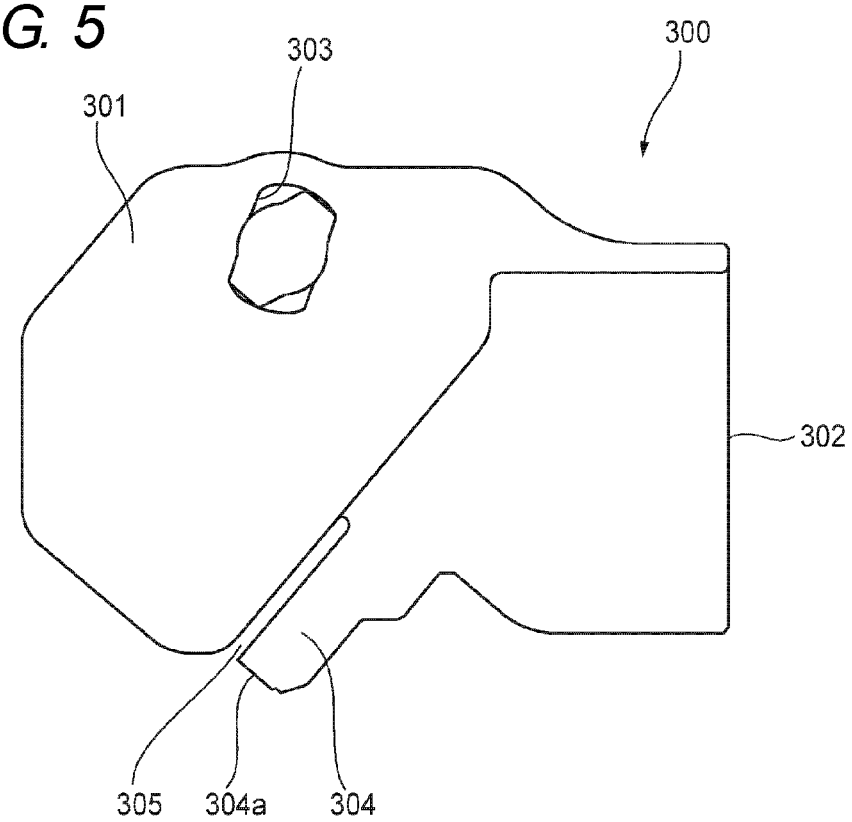
FIG. 5 is a side view of the lever.

In an inner side surface of each temporary lock arm 304 in the up/down direction, a reinforcing rib 306 extending in the extending direction of the temporary lock arm 304 is formed in an opposite side end surface to a corresponding one of the cuts 305 (for example, see FIG. 3 and FIG. 4). Due to the reinforcing ribs 306 formed thus, rigidity can be enhanced against outward deformation of the temporary lock arms 304 in the up/down direction (in a direction away from the surface of the female housing 200), as compared with a case where the reinforcing ribs 306 are absent. As a result, in the lever 300 located in the temporary lock position, the temporary lock arms 304 and the temporary lock protrusions 206 can be surely prevented from being unintentionally separated (released from the locking).

Tapered faces 306*a* are formed in front end portions of the reinforcing ribs 306 in the extending directions thereof respectively. At the fitting time, the tapered faces 306*a* of the pair of temporary lock arms 304 are pushed by front end surfaces 104*a* (see FIG. 1) of the corresponding temporary lock releasing ribs 104 of the male housing 100 so that the pair of temporary lock arms 304 can be elastically deformed outward in the up/down direction as shown by the arrows in FIG. 6. As a result, the locking of the temporary lock arms 304 by the temporary lock protrusions 206 is released so that the lever 300 can move forward in the rotating direction from the temporary lock position toward the final lock position.

Figure 6:
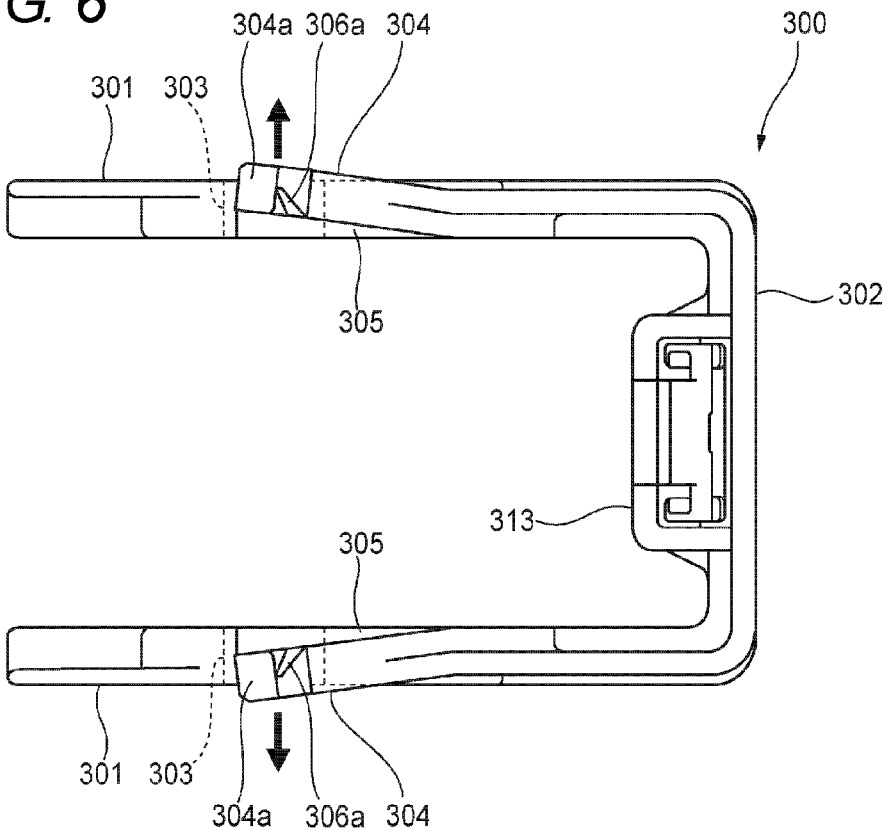
FIG. 6 is a view for explaining a state in which a temporary lock arm of the lever is deformed.

As shown in FIG. 6, due to the existence of the pair of cuts 305, the pair of temporary lock arms 304 are deformed preferentially when the temporary lock arms 304 are elastically deformed outward in the up/down direction. Thus, the side plate portions 301 as a whole (particularly around the pair of holes 303) are hardly elastically deformed outward in the up/down direction. Therefore, the pair of holes 303 are hardly detached from the pair of rotating shafts 205, as compared with a case where the cuts 305 are absent.

As a result, the lever 300 and the female housing 200 can be prevented from being easily separated (that is, the lever 300 can be prevented from easily coming off).

Grooves 307 are formed in the inner side surfaces of the pair of side plate portions 301 in the up/down direction respectively (for example, see FIG. 3 and FIG. 4). The pair of grooves 307 are provided to draw the pair of bosses 106 of the male housing 100 from entrance portions 308 of the grooves 307 to deepest portions 309 thereof as the lever 300 is rotated from the temporary lock position to the final lock position (as will be described in detail later). Incidentally, each groove 307 is defined by a side wall 310 located forward in the rotating direction, and a side wall 311 located rearward in the rotating direction and continuously to the side wall 310.

A through hole 312 is formed in the connection portion 302 of the lever 300. A base portion 313 is formed integrally with the connection portion 302 so as to close a rear part of the through hole 312 in the rotating direction from the back side of the connection portion 302. The base portion 313 includes a pair of side plate portions 314 like flat plates, and a bottom plate portion 315 like a flat plate. The side plate portions 314 protrude on the back side from back side surfaces of the connection portion 302, and face each other at a predetermined interval in the up/down direction. The bottom plate portion 315 connects protruding end portions of the pair of side plate portions 314 with each other. When the lever 300 is attached to the female housing 200, outer side surfaces of the pair of side plate portions 314 in the up/down direction extend toward the female housing 200 and at a predetermined interval in a parallel direction to the pair of rotating shafts 205 of the female housing 200.

In a front side surface of the bottom plate portion 315, a cantilever-like lock arm 316 is formed integrally to extend forward in the rotating direction so as to have a fixed end on its rear side in the rotating direction. A lock hole 317 which is a through hole is formed in a front end portion of the lock arm 316. On the front surface side of the lock arm 316, a releasing arm 318 is formed integrally. The releasing arm 318 has a pair of arm portions 319, and an operating portion 320. The arm portions 319 extend rearward in the rotating direction, at an interval in the up/down direction and in parallel with each other from upper and lower positions of the lock hole 317 of the lock arm 316 respectively. The operating portion 320 connects front end portions of the pair of arm portions 319 with each other.

The base portion 313 and the lock arm 316 are provided so that the lever 300 located in the final lock position can be retained in the final lock position by the base portion 313 and the lock arm 316 in cooperation with a pair of the pairs of ribs 207 (one of the recess portions 208) and one of the lock beaks 209 of the female housing 200 (see FIG. 2).

Specifically, when the lever 300 is moved (rotated) from the temporary lock position toward the final lock position, the base portion 313 is received in the recess portion 208 so that the pair of side plate portions 314 can be held between the pair of ribs 207. When the lever 300 reaches the final lock position in the state where the base portion 313 has been received in the recess portion 208, the lock arm 316 abuts against the lock beak 209 and goes through elastic deformation on the front surface side of the lock arm 316. Thus, the lock hole 317 of the lock arm 316 is locked to the step portion 209*a* of the lock beak 209.

Since the lock hole 317 is locked to the step portion 209*a*, the lever 300 located in the final lock position can be retained in the final lock position. On the other hand, when the operating portion 320 of the releasing arm 318 is pushed toward the female housing 200 in this state, the lock arm 316 is elastically deformed on the front surface side to thereby release the locking of the lock hole 317 to the step portion 209*a*. As a result, the lever 300 can move from the final lock position toward the temporary lock position (rearward in the rotating direction).

An operation in which the lever 300 attached to the female housing 200 is rotated from the temporary lock position to the final lock position to thereby draw the male housing 100 from a fitting start state to a fitting completion state will be described below briefly with reference to FIGS. 7 to 12.

Figure 7:
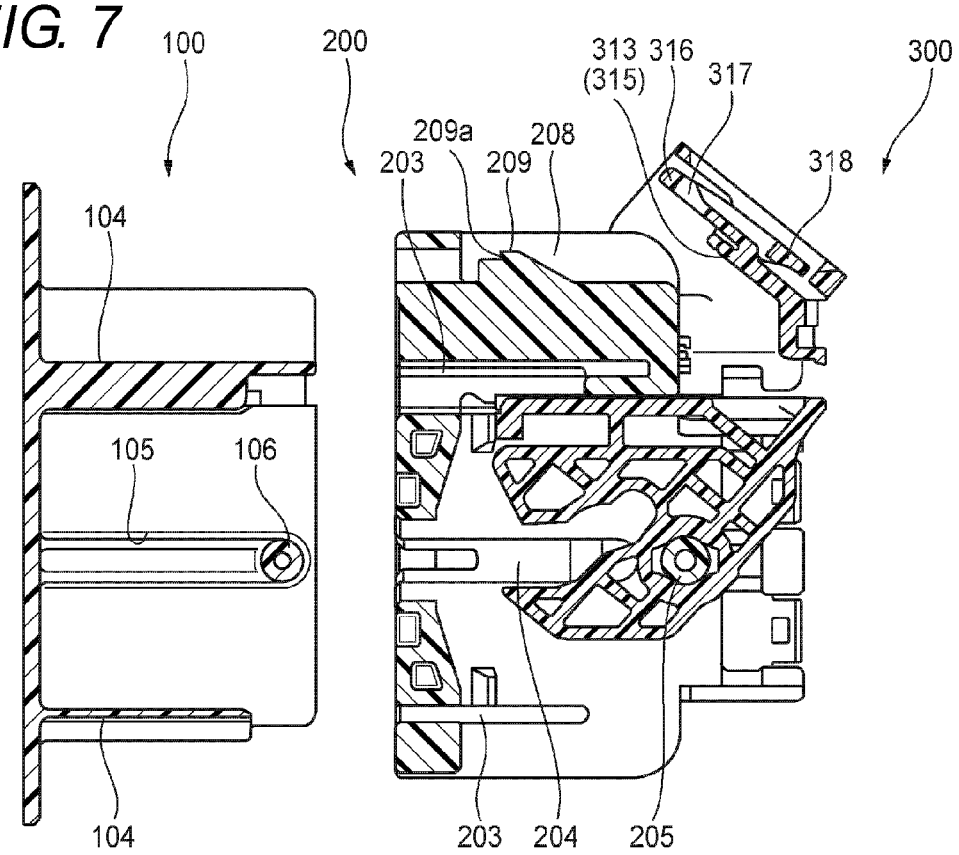
FIG. 7 is a sectional view taken on line A-A in FIG. 1, showing a state in which a male housing and the female housing have not been fitted to each other yet.

First, the front surface of the female housing 200 in which the lever 300 has been locked in the temporary lock position and the front surface of the male housing 100 are disposed to face each other as shown in FIG. 7. As shown in FIG. 7, in the state where the lever 300 is in the temporary lock position, the base portion 313 has not been received in the recess portion 208 yet.

Figure 8:
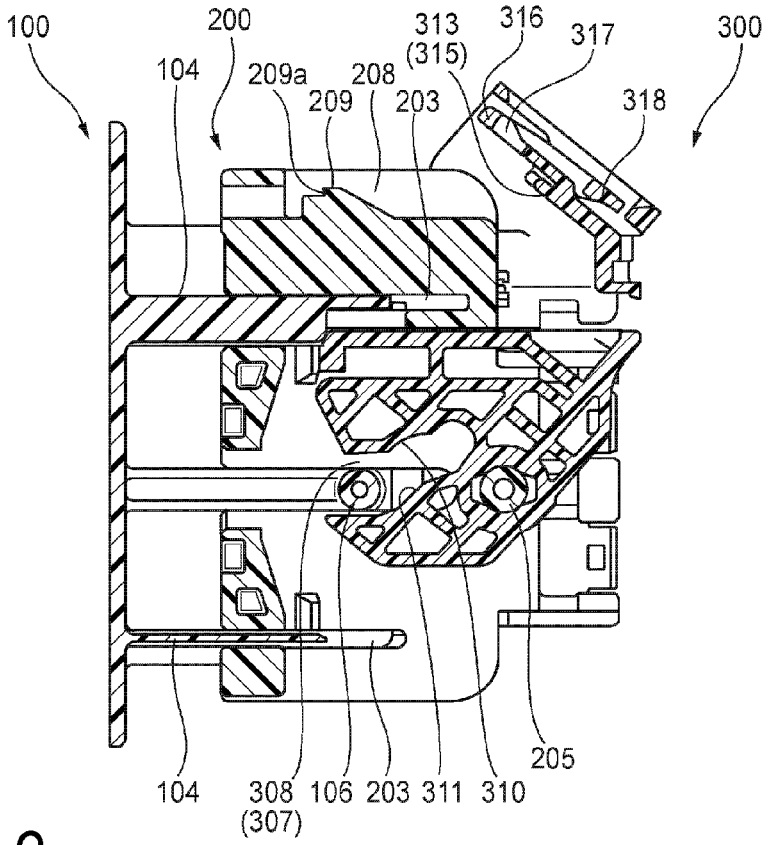
FIG. 8 is a sectional view taken on line A-A in FIG. 1, showing a state in which the male housing and the female housing begin to be fitted to each other.

Next, as shown in FIG. 8, the male housing 100 is inserted into the female housing 200 to reach a fitting start state. In the fitting start state, the tapered faces 306*a* (see FIGS. 3 and 4) of the pair of temporary lock arms 304 are pushed by the front end surfaces 104*a* (see FIG. 1) of the corresponding temporary lock releasing ribs 104 of the male housing 100 respectively, so that the pair of temporary lock arms 304 are elastically deformed outward in the up/down direction. Thus, the lever 300 can move from the temporary lock position to the final lock position. In the fitting start state, the pair of bosses 106 of the male housing 100 are located in the entrance portions 308 (see FIGS. 3 and 4) of the pair of grooves 307 of the lever 300.

Figure 9:
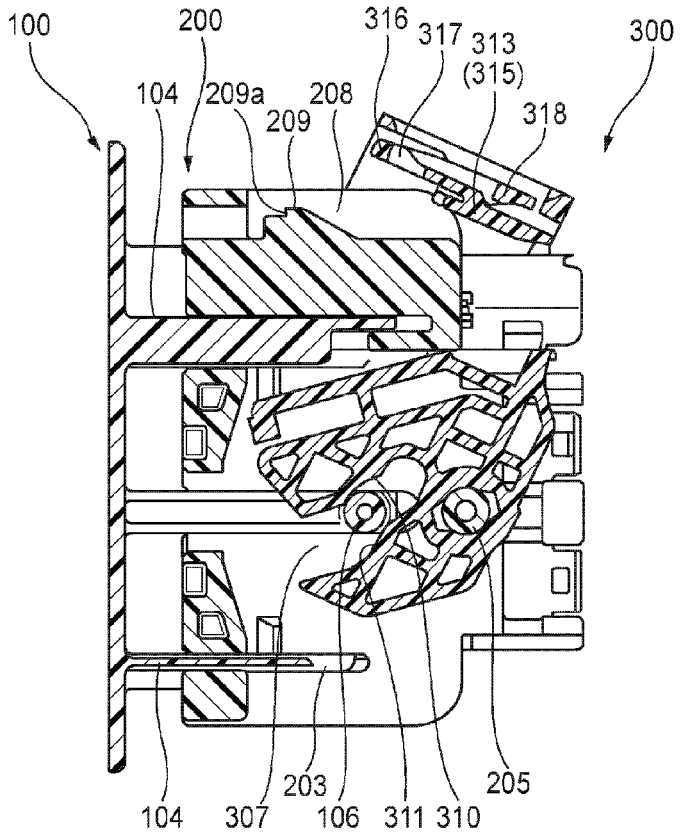
FIG. 9 is a sectional view taken on line A-A in FIG. 1, showing a state in which the male housing and the female housing are being fitted to each other.
Figure 11:
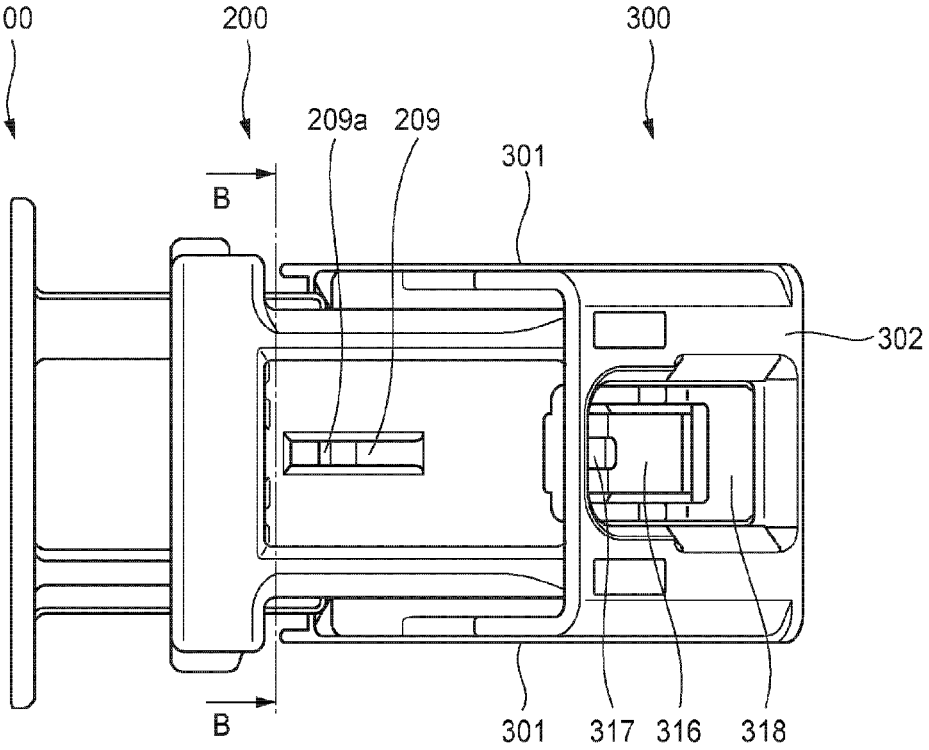
FIG. 11 is a side view of the male housing and the female housing in the state (in which the male housing and the female housing are being fitted to each other) shown in FIG. 9.
Figure 12:
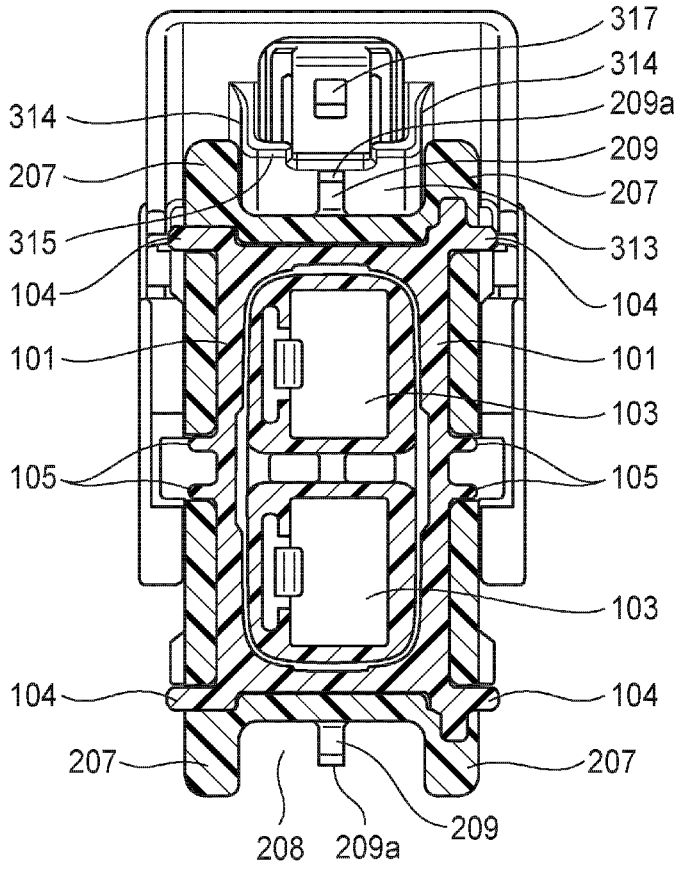
FIG. 12 is a sectional view taken on B-B in FIG. 11.

Staring in the fitting start state, the lever 300 is moved (rotated) from the temporary lock position toward the final lock position. Thus, as shown in FIG. 9, the side walls 310 of the grooves 307 push the bosses 106 toward the rear of the female housing 200 so that the bosses 106 (and hence the male housing 100) can be drawn toward the rear of the female housing 200 in accordance with the advance of the movement (rotation) of the lever 300. Further, as shown in FIG. 9 and FIGS. 11 and 12, the base portion 313 begins to be received in the recess portion 208 when the lever 300 is moving from the temporary lock position to the final lock position.

Figure 10:
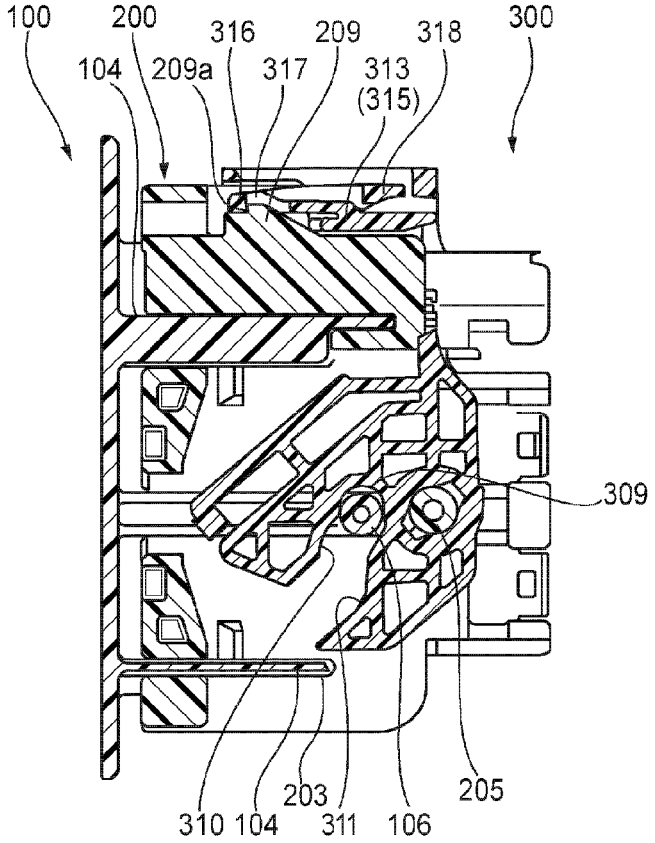
FIG. 10 is a sectional view taken on line A-A in FIG. 1, showing a state in which the male housing and the female housing have been completely fitted to each other.

Then, as shown in FIG. 10, when the lever 300 reaches the final lock position in the state where the base portion 313 has been received in the recess portion 208, the bosses 106 reach the deepest portions 309 (see FIGS. 3 and 4) of the grooves 307 to thereby bring the male housing 100 into the fitting completion state. At the same time, as described above, the lock hole 317 of the lock arm 316 is locked to the step portion 209*a* of the lock beak 209. Consequently, conductive connection between male terminals (not shown) and female terminals (not shown) provided in the male housing 100 and the female housing 200 respectively is completed while the lever 300 is retained in the final lock position.

Incidentally, in the above-described example, the locking of the pair of temporary lock arms 304 has been already released in the fitting start state (FIG. 8). However, the locking of the pair of temporary lock arms 304 may be still kept in the fitting start state. In this case, the male housing 100 is inserted up to the fitting start state in a state where the lever 300 has been retained in a position moving slightly rearward in the rotating direction from the temporary lock position. In the fitting start state, the tapered faces 306*a* (see FIGS. 3 and 4) of the pair of temporary lock arms 304 abut against the front end surfaces 104*a* (see FIG. 1) of the corresponding temporary lock releasing ribs 104 of the male housing 100, but are not pushed by the front end surfaces 104*a*. Accordingly, the pair of temporary lock arms 304 are not elastically deformed outward in the up/down direction. Thus, the lever 300 cannot move forward in the rotating direction from the temporary lock position.

In this state, the lever 300 located in the position moving slightly rearward in the rotating direction from the temporary lock position is moved forward in the rotating direction (toward the temporary lock position). Thus, the side walls 310 of the grooves 307 push the bosses 106 toward the rear of the female housing 200 (to receive the bosses 106 in the grooves 307). Consequently, the tapered faces 306*a* of the pair of temporary lock arms 304 are pushed by the front end surfaces 104*a* of the corresponding temporary lock releasing ribs 104 so that the pair of temporary lock arms 304 can be elastically deformed outward in the up/down direction. As a result, the lever 300 can be brought into a state where the lever 300 can move from the temporary lock position toward the final lock position. Thus, the lever 300 can pass through the temporary lock position smoothly.

Incidentally, in order to release the fitting between the male housing 100 and the female housing 200 in the fitting completion state, the operating portion 320 of the releasing arm 318 is pushed to release the locking of the lock hole 317 to the step portion 209*a* as described above. In this state, the lever 300 is moved rearward in the rotating direction from the final lock position toward the temporary lock position. With the movement of the lever 300, the side walls 311 of the grooves 307 push the bosses 106 (and hence the male housing 100) toward the front of the female housing 200 (that is, push out the bosses 106 from the grooves 307). Thus, the male housing 100 is separated toward the front of the female housing 200 so that the fitting can be released.

According to the connector 10 according to the embodiment of the invention, the pair of temporary lock arms 304 provided in the lever 300 are locked to the temporary lock protrusions 206 of the female housing 200 when the lever 300 is in the temporary lock position. At the fitting time, the pair of temporary lock arms 304 are elastically deformed by the temporary lock releasing ribs 104 provided in the male housing 100, so as to be released from the locking to the temporary lock protrusions 206. Further, the temporary lock arms 304 have the reinforcing ribs 306 enhancing rigidity against deformation. Thus, it is possible to more surely prevent the temporary lock arms 304 and the temporary lock protrusions 206 from being unintentionally separated (released from the locking), as compared with a case where the reinforcing ribs are absent as in the above-described related-art connector. Thus, the lever 300 can be prevented from unintentionally moving from the temporary lock position when fitting between the housings is not established.

Further, in the lever 300, the cuts 305 are provided between the pair of side plate portions 301 to be connected to the female housing 200, and the pair of temporary lock arms 304. As a result, each temporary lock arm 304 has a cantilever-like shape. Due to the cuts 305, the vicinities of the connection portions (holes 303) between the leer 300 and the female housing 200 are hardly deformed even when the temporary lock arms 304 are pushed by the temporary lock releasing ribs 104, as compared with a case where the cuts are absent. As a result, the lever 300 and the female housing 200 are hardly separated from each other (that is, the lever 300 hardly comes off). Thus, it is possible to make it compatible to attain both the prevention of the temporary lock arms 304 and the temporary lock protrusions 206 from being unintentionally separated (released from locking), and the prevention of the lever 300 from being separated from the female housing 200 (that is, the prevention of the lever 300 from coming off).

In addition, at the fitting time, the temporary lock releasing ribs 104 of the male housing 100 can be easily directed toward the temporary lock arms 304 through the slits 203. To say other words, the temporary lock releasing ribs 104 and the temporary lock arms 304 can be easily aligned with each other. Thus, it is possible to further improve workability at the fitting time.

Other Forms

Incidentally, the invention is not limited to the above-described embodiment, but various modifications can be used within the scope of the invention. For example, changes, improvements, etc. can be made on the invention without limiting the invention to the above-described embodiment. In addition, materials, shapes, dimensions, numbers, arrangement places, etc. of respective constituent elements in the above-described embodiment are not limited. Any materials, any shapes, any dimensions, any numbers, any arrangement places, etc. may be used as long as the invention can be attained.

For example, although the lever 300 is attached to the female housing 200 in the above-described embodiment, the lever 300 may be attached to the male housing 100. In addition, in the above-described embodiment, the lever 300 is rotated from the temporary lock position to the final lock position so that the male housing 100 and the female housing 200 can be drawn toward each other. However, according to another configuration, the lever 300 may be moved in parallel from the temporary lock position to the final lock position so that the male housing 100 and the female housing 200 can be drawn toward each other.

Further, although the cuts 305 are provided between the side plate portions 301 of the lever 300 and the temporary lock arms 304 in the above-described embodiment, such cuts do not have to be provided. Further, in the above-described embodiment, the slits 203 for guiding the temporary lock releasing ribs 104 of the male housing 100 toward the temporary lock arms 304 of the lever 300 at the fitting time are provided in the female housing 200. However, such slits do not have to be provided.

In addition, in the above-described embodiment, the temporary lock releasing ribs 104 are provided on the opposite sides of the body peripheral wall portion 101 of the male housing 100 in the width direction, and the slits 203, the temporary lock protrusions 206, the pairs of ribs 207 (the recess portions 208) and the lock beaks 209 are provided on the opposite sides of the body peripheral wall portion 201 of the female housing 200 in the width direction. Thus, the connector 10 can operate even when the lever 300 is attached to either side of the female housing 200 in the width direction. However, when the lever 300 is attached to only one side of the female housing 200 in the width direction, a temporary lock releasing rib 104 may be provided only on one side of the body peripheral wall portion 101 of the male housing 100 in the width direction, and a slit 203, a temporary lock protrusion 206, a pair of ribs 207 (a recess portion 208) and a lock beak 209 may be provided on only one side of the body peripheral wall portion 201 of the female housing 200 in the width direction.

Here, the features of the above-described embodiment of the connector according to the invention will be summarized and listed briefly in the following items <1> to <3>.

<1> A connector (10) including: a first housing (200); a second housing (100) fittable to the first housing (200); and a lever (300) attachable to the first housing (200) to draw and fit the first housing and the second housing to each other by moving from a temporary lock position to a final lock position, wherein the lever (300) includes a lever-side lock portion (304) which is elastically deformable in a first direction away from a surface of the first housing (200), and which includes a reinforcing rib (306) that enhances rigidity against a deformation of the lever-side lock protrusion (304), wherein the first housing (200) includes a housing-side lock portion (206) which locks the lever-side lock portion (304) when the lever (300) is in the temporary lock position, which inhibits movement of the lever (300) to the final lock position when the housing-side lock portion (206) locks the lever-side lock portion (304), and which permits the lever (300) to move to the final lock position when the housing-side lock portion (206) is released from locking of the lever-side lock portion (304), and wherein the second housing (100) includes a lock releasing portion (104) which pushes the lever-side lock portion (304) in the first direction so as to release locking between the lever-side lock portion (304) and the housing-side lock portion (206).

<2> The connector according to the item (1), wherein the lever (300) further includes a connection portion (303) that is connected to the first housing (200) so that the lever (300) can perform the movement, and a cut (305) that is provided between the connection portion (303) and the lever-side lock portion (304), and wherein the lever-side lock portion (304) has a cantilever-like shape having a fixed end near a deepest portion of the cut (305).

<3> The connector according to the item (1) or (2), wherein the first housing (200) and the second housing (100) are fitted to each other such that a peripheral wall of the first housing (200) and a peripheral wall of the second housing (100) overlap each other, and wherein the first housing (200) includes a guide slit (203) which penetrates the peripheral wall of the first housing and which extends in a fitting direction so as to guide the lock releasing portion (104) toward the lever-side lock portion (304) in a state in which the lock releasing portion (104) has penetrated the peripheral wall of the first housing (200).

What is claimed is:

1. A connector comprising:

a first housing;

a second housing fittable to the first housing; and a lever attachable to the first housing to draw and fit the first housing and the second housing to each other by moving from a temporary lock position to a final lock position, wherein the lever comprises a lever-side lock portion which is elastically deformable in a first direction away from a surface of the first housing, and which comprises a reinforcing rib that enhances rigidity against a deformation of the lever-side lock protrusion, wherein the first housing comprises a housing-side lock portion which locks the lever-side lock portion when the lever is in the temporary lock position, which inhibits movement of the lever to the final lock position when the housing-side lock portion locks the lever-side lock portion, and which permits the lever to move to the final lock position when the housing-side lock portion is released from locking of the lever-side lock portion, and wherein the second housing comprises a lock releasing portion which pushes the lever-side lock portion in the first direction so as to release locking between the lever-side lock portion and the housing-side lock portion.

2. The connector according to claim 1, wherein the lever further comprises a connection portion that is connected to the first housing so that the lever can perform the movement, and a cut that is provided between the connection portion and the lever-side lock portion, and wherein the lever-side lock portion has a cantilever-like shape having a fixed end near a deepest portion of the cut.

3. The connector according to claim 1, wherein the first housing and the second housing are fitted to each other such that a peripheral wall of the first housing and a peripheral wall of the second housing overlap each other, and wherein the first housing comprises a guide slit which penetrates the peripheral wall of the first housing and which extends in a fitting direction so as to guide the lock releasing portion toward the lever-side lock portion in a state in which the lock releasing portion has penetrated the peripheral wall of the first housing.

* * * * *